United States Patent [19]

Tipton et al.

[11] Patent Number: 4,849,123

[45] Date of Patent: Jul. 18, 1989

[54] DRIVE TRAIN FLUIDS COMPRISING OIL-SOLUBLE TRANSITION METAL COMPOUNDS

[75] Inventors: Craig D. Tipton, Perry; James J. Schwind, Willowick, both of Ohio

[73] Assignee: The Lubrizol Corporation, Wickliffe, Ohio

[21] Appl. No.: 868,831

[22] Filed: May 29, 1986

[51] Int. Cl.[4] ..... C10M 129/26; C10M 129/92

[52] U.S. Cl. ..... 252/75; 252/32.7 E; 252/33; 252/33.6; 252/35; 252/37.7; 252/42.7; 252/74; 252/76; 252/79

[58] Field of Search ..... 252/32.7 E, 33, 83.6, 252/35, 37.7, 42.7, 74, 75, 76, 79

[56] References Cited

U.S. PATENT DOCUMENTS

| | | | |
|---|---|---|---|
| 2,795,549 | 6/1957 | Abbott et al. | 252/75 |
| 3,250,716 | 5/1966 | Akers | 252/75 |
| 3,490,737 | 1/1970 | Giesking et al. | 252/74 |
| 3,944,495 | 3/1976 | Wiley et al. | 252/75 |
| 4,122,033 | 10/1978 | Black | 252/400 A |
| 4,397,749 | 9/1983 | Shippey | 252/42.7 |
| 4,466,901 | 9/1984 | Hunt | 252/32.7 |
| 4,532,062 | 7/1985 | Ryer et al. | 252/78.1 |
| 4,552,677 | 11/1985 | Hopkins | 252/33.6 |

FOREIGN PATENT DOCUMENTS

| | | |
|---|---|---|
| 8546694 | 8/1985 | Australia . |
| 0024146 | 2/1981 | European Pat. Off. . |

OTHER PUBLICATIONS

Graham et al. "Automatic Transmission Fluids-Developments Toward Rationalization" presented at the CEC 1985 International Symposium, Jun. 7, 1985, Wolfsberg, Germany.

Schiemann et al., "Impact of Vehicle Changes Upon Gear Lubricant Requirements," SAE paper No. 831732 presented at the SAE Fuels and Lubricants meeting, San Francisco, Calif., Nov., 1983.

*Primary Examiner*—Robert A. Wax

*Attorney, Agent, or Firm*—Forrest L. Collins; Robert A. Franks; Roger Y. K. Hsu

[57] ABSTRACT

Improved automatic transmission fluids (ATF's) and gear lubricant compositions comprising a low concentration of an oil-soluble transistion metal compound are provided. The transition metal compound ameliorates low temperature thickening in ATF's and high temperature thickening in gear lubricants.

28 Claims, No Drawings

DRIVE TRAIN FLUIDS COMPRISING OIL-SOLUBLE TRANSITION METAL COMPOUNDS

BACKGROUND OF THE INVENTION

1. Field of the Invention

This invention relates to Drive Train Fluids (DTF's) which include automatic transmission fluids (AFT's), manual transmission fluids, gear and axle lubricants, comprising oil-soluble transition metal compounds with the exception of zinc compounds. Various oil-soluble transition metal compounds have been discovered to ameliorate low temperature thickening in, e.g., automatic transmission fluids and high temperature thickening and the formation of insolubles in fluids such as gear lubricants. The oil-soluble transition metal compounds may be formulated in relatively low concentrations with the particular Drive Train fluid to achieve the desired effect.

2. State of the Art

Since 1949 when General Motors developed the first fluid specifically for use in automatic transmisions, automatic transmission fluids have become accepted for use in a wide variety of applications. These include not only automatic transmissions of commercial vehicles and city buses, but also for power steering pumps, manual gear boxes, power shift transmissions and hydraulic equipment including vane and piston pumps. These various applications as well as the specifications and property requirements for such automatic transmission fluids is discussed in a paper presented by R. Graham and W. R. Oviatt titled "Automatic Transmission Fluids—Developments Toward Rationalization" at the CEC 1985 International Symposium, June 7, 1985, Wolfsberg, Germany.

Like automatic transmission fluids, gear and axle lubricants have a wide application in automotive equipment. Because of this wide use of automotive gear lubricants for numerous applications, the gear lubricants, as well as axle lubricants, in use today must be formulated to have a wide range of properties and meet a variety of specifications. Such requirements and specifications for gear lubricants are discussed, for example, in a paper by L. F. Schiemann et al titled "Impact of Vehicle Changes Upon Gear Lubricant Requirements," SAE paper No. 831732 presented at the SAE Fuels and Lubricants Meeting, San Francisco, Calif., Nov., 1983.

Additives have been widely used in automatic transmission fluids for improving the properties of these fluids, for example, in U.S. Pat. No. 4,532,062 various amine or ammonium salts of mercaptobenzothiazole are disclosed as additives which are useful as corrosion inhibitors, antioxidants and friction modifiers for automatic transmission fluids.

Various transition metal compounds have been employed in lubricating oils, specifically crankcase oils to improve the properties of these oils. For example, in U.S. Pat. No. 4,397,749, various oil-insoluble metal thiolates are combined with alkenyl or alkylmono- or bissuccinimides to render the metal thiolates oil-soluble, and these complexes are then formulated with lubricating oils as effective antioxidants and antiwear agents.

Likewise, in U.S. Pat. No.4,466,901, various molybdenum-containing compounds are added to lubricating oils as friction modifying agents. In U.S. Pat. No. 4,552,677, copper salts of succinic anhydride derivatives are added to lubricating oils, particularly crankcase lubricating oils to act as antioxidant agents and friction modifying agents.

In European Patent Application No. 24,146, lubricating oils, specifically crankcase oils, are disclosed containing a low concentration of oil-soluble copper compounds as an antioxidant.

None of the foregoing disclosures disclose or suggest the use of transition metal compounds in automatic transmission fluids or gear lubricants, particularly in the concentration range of the present invention and for the particular purpose of the present invention.

SUMMARY OF THE INVENTION

In accordance with the present invention, Drive Train fluids that exhibit an improved resistance to thickening at different temperatures dependent on the particular use of the fluid and improved friction stability are provided.

Further in accordance with the present invention, automatic and manual transmission fluids are provided that exhibit a significantly improved resistance to low temperature thickening as well as improved friction stability.

Still further in accordance with the present invention, gear and axle lubricant compositions are provided which exhibit improved resistance to high temperature thickening and a dramatic reduction in the formation of insoluble resins.

Still further, in accordance with the present invention, automatic and manual transmission fluids and gear and axle lubricants comprising relatively low concentrations of oil-soluble transition metal compounds are provided.

Still further, in accordance with the present invention, a method for ameliorating high temperature thickening of gear and axle lubricants and low temperature thickening of automatic and manual transmission fluids is provided.

Still further in accordance with the present invention, fully formulated concentrates for preparing automatic or manual transmission fluids, or a gear or axle lubricant comprising an anti-thickening effective amount of an oil-soluble transition metal compound is provided.

These and other aspects of the invention will become clear to those skilled in the art upon the reading and understanding of the specification.

DETAILED DESCRIPTION OF THE INVENTION

It has surprisingly been discovered that low temperature thickening of various problem oil stocks, particularly naphthenic stocks, used in the preparation of automatic or manual transmission fluids may be ameliorated by formulating the automatic transmission fluid as well as manual transmission fluid with a relatively low concentration of an oil-soluble transition metal compound. It has further been discovered that friction stability may be maintained over a wider range by the addition of oil-soluble transition metal compounds to automatic or manual transmission fluid formulations.

Even more surprising was the discovery in accordance with the present invention that high temperature thickening often experienced in gear lubricants may be ameliorated by the addition of a relatively low concentration of various oil-soluble transition metal compounds as well as a dramatic reduction in the formation of insoluble resins.

Automatic transmission fluids are very complex materials which are required to transmit power efficiently, smoothly and quietly at all vehicle speeds, to transfer heat, and to lubricate the bearings and gears in the transmission. These fluids must be effective through a wide range of ambient temperatures in order to make the vehicle useful in all climates. The petroleum base stocks used in the formulation must be stable to the effects of oxidation while possessing a high viscosity index as well as a low pour point. In order that such ATF formulations exhibit the above range of properties, various additives are used in an ATF formulation which include, for example:

antioxidants;
extreme pressure agents;
anti-squawk agents;
corrosion inhibitors;
dispersants;
viscosity index improvers;
pour point depressants.

As pointed out above, it is highly desirable for the automatic transmission fluid to be effective through a wide range of different temperatures including low temperatures of colder climates. It is self-evident that large viscosity increase at a low temperature would affect the efficient operation of the transmission, particularly immediately after starting the vehicle. Therefore, for example, to obtain DEXRON ® II approval for use in General Motor Corp. automobiles, ATF formulations are subjected to the THOT (Turbo Hydra-Matic Oxidation Test). In this test, the viscosity of a used ATF formulation is measured at −10° F. where the maximum allowable viscosity at this temperature is 6000 cp. It has been found that the ATF formulation of the present invention which comprises a relatively low concentration of an oil-soluble transition metal compound does not exhibit a −10° F. viscosity increase problem in the D-2983 (−10° F.) Brookfield viscosity conducted on oxidized ATF drains from the THOT. Manual transmission fluids have similar problems under such conditions amd show improvement when formulated with an oil-soluble transition metal compound of the present invention.

Gear and axle lubricants, like automatic transmission fluids, are required to function over a wide range of conditions. Thus, gear lubricants are formulated to prevent premature component failure (gears, bearings, cross shafts and the like), assure reliable operation and increase equipment service life. In terms of equipment service life, the most critical function of a gear lubricant is the minimization of friction and wear. Therefore, a typical gear lubricant is formulated as follows:

50–95% base oil;
0–35% viscosity improver;
0–3% pour point depressant;
5–12% performance package.

The performance package typically contains:

extreme pressure agents;
oxidation inhibitor;
corrosion inhibitor;
foam inhibitor;
friction modifier.

It has been discovered in accordance with the present invention that by including an oil-soluble transition metal compound in a fully formulated ATF or gear lubricant as discussed above, the properties of these fluids are improved for use in automotive and truck equipment.

Suitable transition metal compounds include compounds of transition metals of Groups IVA, VA, VIA, VIIA, VIIIA, IB and IIB with the exception of zinc compounds which have been found to be ineffective for the purposes of the present invention. Preferred compounds are compounds of the transition metals: copper, cobalt, nickel, tungsten, titanium, manganese, molybdenum, iron, chromium, vanadium and mixtures thereof. The most preferred compounds are compounds of copper.

The particular anionic or non-metal moiety of the compound is not particularly critical as long as the compound is oil-soluble. Such anionic or non-metal moieties include dihydrocarbylthio- or dithiophosphate, a dihydrocarbylthio- or dithiocarbamate, a hydrocarbyl carboxylic acid or derivatives thereof, a hydrocarbyl sulfonate, or a hydrocarbyl phenate. Preferred anionic or non-metal moieties include alkyl benzene sulfonates, alkyl sulfonates, dialkyl dithiophosphates, naphthenates, stearates, palmitates, oleates, dodecanoates, acetyl acetonates, 2-ethyl hexanoates, neo-decanoates and mixtures thereof. The most preferred of these various moieties are mixed fatty acid moieties such as oleate and stearate. Other most preferred moieties are naphthenates and dialkyl dithiophosphates as well as mixtures thereof.

As used herein, the terms "hydrocarbyl" or "hydrocarbon-based" denote a radical having a carbon atom directly attached to the remainder of the molecule and having predominantly hydrocarbon character within the context of this invention. Such radicals include the following:

(1) Hydrocarbon radicals; that is, aliphatic (e.g., alkyl or alkenyl), alicyclic (e.g., cycloalkyl or cycloalkenyl), aromatic, aliphatic- and alicyclic-substituted aromatic, aromatic-substituted aliphatic and alicyclic radicals, and the like, as well as cyclic radicals wherein the ring is completed through another portion of the molecule (that is, any two indicated substituents may together form an alicyclic radical). Such radicals are known to those skilled in the art; examples are:

(2) Substituted hydrocarbon radicals; that is, radicals containing non-hydrocarbon substituents which, in the context of this invention, do not alter the predominantly hydrocarbon character of the radical. Those skilled in the art will be aware of suitable substituents; examples are:

(3) Hetero radicals; that is, radicals which, while predominantly hydrocarbon in character within the context of this invention, contain atoms other than carbon present in a chain or ring otherwise composed of carbon atoms. Suitable hetero atoms will be apparent to those skilled in the art and include, for example, nitrogen, oxygen and sulfur.

Terms such as "alkyl-based radical," "aryl-based radical" and the like have meaning analogous to the above with respect to alkyl and aryl radicals and the like.

The radicals are usually hydrocarbon and especially lower hydrocarbon, the word "lower" denoting radicals containing up to seven carbon atoms. They are preferably lower alkyl or aryl radicals, most often alkyl.

The amount of the oil-soluble transition metal compound added to the automatic or manual transmission fluid must be in an amount sufficient to effectively ameliorate or reduce low temperature thickening. Likewise, the amount of these compounds added to a gear or axle lubricant must be an amount which effectively ameliorates or avoid high temperature thickening in the gear lubricant. It has been found that this amount for ATF's may range from about 1 ppm to about 450 ppm by weight. A more preferred range is in the amount of 1 ppm to about 150 ppm and a most preferred range is in the amount of about 20 ppm to about 100 ppm by weight. For gear lubricants, the preferred range is about 25 ppm to about 300 ppm and the most preferred range is about 150 ppm to about 250 ppm.

A typically formulated automatic transmission fluid is set out in TABLE I below.

TABLE I

| COMPONENTS | CONCENTRATION RANGE (VOL. %) |
|---|---|
| V.I. Improver | 1-15 |
| Corrosion Inhibitor | 0.01-1 |
| Oxidation Inhibitor | 0.01-1 |
| Dispersant | 0.5-10 |
| Pour Point Depressant | 0.01-1 |
| Demulsifier | 0.001-0.1 |
| Anti-Foaming Agents | 0.001-0.1 |
| Antiwear Agents | 0.001-1 |
| Seal Swellant | 0.1-5 |
| Friction Modifier | 0.01-1 |
| Mineral Oil Base | Balance |

Typical base oils for drive train fluids, generally include a wide variety of light hydrocarbon mineral oils, such as, naphthenic base, paraffin base and mixtures thereof, having a lubricating viscosity range of about 34 to 45 Saybolt Universal Seconds at 38° C.

The metal compound may be blended into the ATF, the manual transmission or the gear or axle lubricant as any suitable oil-soluble metal compound, by oil-soluble we mean the compound is soluble under normal blending conditions in the ATF, gear lubricant or additive package. The metal compound may be in the form of the dihydrocarbylthio-or dithiophosphates wherein the metal compound may be substituted for zinc compounds. Alternatively, the metal compound may be added as the metal salt of a synthetic or natural carboxylic acid. Examples include $C_{10}$ to $C_{18}$ fatty acids such as stearic or palmitic, but unsaturated acids such as oleic or branched carboxylic acids such as naphthenic acids of molecular weight from 200 to 500 or synthetic carboxylic acids are preferred because of the improved handling and solubility properties of the resulting metal carboxylates.

Oil-soluble metal dithiocarbamates of the general formula $(RR'NCSS)_nM$ (where n is 1 or 2 and R and R' are the same or different and are hydrocarbyl, and M is one of the metal cations described above). As previously indicated, metal sulphonates, phenates and acetyl acetonates may also be used.

It has been found that when used in combination with the zinc dialkyl dithiophosphates, the quantity of the metal compound in the ATF or gear lubricant is important to obtaining the combination of antioxidant and antiwear properties needed for extended life of these functional fluids.

Also a fully formulated concentrate of the above components, including the oil-soluble transition metal compounds, may be prepared for subsequent blending in the base stock or oil. Such a concentrate may comprise from about 20% to about 99% by weight combined with all of the above discussed components including the oil-soluble transition metal compounds and the remainder of a compatible solvent or diluent. This concentrate may then be blended with a base stock or oil to prepare an automatic or manual transmission fluid or a gear or axle lubricant.

The present invention is further illustrated in the following examples. While these examples will show one skilled in the art how to operate within the scope of this invention, they are not to serve as a limitation on the scope of the invention where such scope is defined only in the claims. ATF compositions used in the examples below are formulated in accordance with the components and concentration noted above in TABLE I.

EXAMPLE I

To a fully formulated ATF composition was admixed 0.026 wt. % of a copper dialkyl dithio phosphate in place of the same amount of a zinc dialkyl dithiophosphate. The copper salt is a mixed isopropyl (40%) and 4-methyl-2-pentyl (60%) phosphorodithioic acids. The ATF composition was a stable homogeneous fluid.

The ATF fluid of this example containing the copper salt of a dialkyl dithiophosphoric acid was evaluated in the Turbo Hydra-Matic Oxidation Test (THOT) (specification GM 6137-M). Results from this evaluation were as follows:

| Test No.[1] | Viscosity[2] (cps −10° F.) |
|---|---|
| 1. Cu | 5260 |
| 2. Zn | 8000 |
| 3. Cu | 5960 |
| 4. Zn | 7015 |

[1]A fully formulated ATF composition in accordance with Example I where Test No's. 1 and 3 contain the copper salt of the dialkyl dithiophosphate and no zinc salt whereas Test No's. 2 and 4 are ATF compositions containing only the zinc salt and no copper salt.

[2]The viscosity of the ATF drain at the end of the THOT at −10° F. A viscosity of less than 6000 cps is required to meet the specifications.

As is evident from the foregoing results, the copper treated ATF composition exhibit much lower viscosity and meet the specification of less than 6000 cps at −10° F. after being subjected to the THOT than the zinc treated compositions.

EXAMPLE II

Various fully formulated ATF compositions were tested according to DEXRON® II SAE #2 HEFCAD test procedures. The ATF compositions tested included typical fully formulated ATF compositions as baselines. To various samples of these ATF compositions were admixed various inhibitors and antioxidants as well as copper as a salt of a mixed fatty acid which is largely oleate and may be purchased from Mooney Chemical Company.

| Sample #[1] | Result |
|---|---|
| 1. 0.16 wt. % copper oleate mixture | pass (142 hrs) |
| 2. baseline ATF composition | fail (72 hrs) |
| 3. hindered phenol inhibitor (.3%) | fail (100 hrs) |
| 4. 0.08% copper oleate mixture | pass (100 hrs) |
| 5. sulfur containing inhibitor | fail |
| 6. 0.5 wt. % of hindered phenol | pass |

[1]Each ATF composition tested differs only by the indicated inhibitor.

The results from the above test demonstrate that copper treated ATF compositions are effective in meeting the specifications of the HEFCAD and only an ATF containing a higher concentration of the hindered phenol passes the HEFCAD.

EXAMPLE III

A fully formulated gear lubricant was tested in the ASTM L-60 test and gave the following results:
viscosity increase: 98.4%
pentane insolubles: 2.35%
toluene insolubles: 1.56%

To an identical fully formulated gear lubricant, as above, was admixed 0.06 wt. % (200 ppm Cu) of the copper dialkyl dithiophosphate salt of Example I. This gear lubricant was also subjected to the ASTM L-60 test with the following results:
viscosity increase: 66.6%
pentane insolubles: 0.25%
toluene insolubles: 0.13%

The above results show the improvement imparted by the addition of the copper salt.

While the invention has been described and illustrated with reference to certain preferred embodiments thereof, those skilled in the art will appreciate that various changes, modifications and substitutions can be made therein without departing from the spirit of the invention. For example, different concentration ranges other than the preferred ranges set forth hereinabove may be applicable as a consequence of variations in the base stock or the type of gear box, transmission or the like. It is intended therefore that the invention be limited only by the scope of the claims which follow.

What is claimed is:

1. An automatic-transmission fluid comprising a low temperature, anti-thickening effective amount of an oil-soluble, transition metal with the proviso that the transition metal is not zinc, wherein said transition metal is a wherein the non-metal moiety is selected from the group consisting of dihydrocarbylthio- or dithiophosphate, a dihydrocarbylthio- or dithiocarbamate, a hydrocarbyl carboxylic acid, a hydrocarbylsulfonate, hydrocarbylphenate or mixtures thereof and wherein the metal is selected from the group consisting of copper, cobalt, tungsten, titanium, manganese, iron, chromium, nickel, vanadium, molybdenum or mixtures thereof.

2. The automatic transmission fluid according to claim said non-metal moiety is selected from the group consisting of alkylbenzenesulfonates, alkylsulfonates, dialkyldithiophosphates, naphthenates, stearate, palmitate, oleate, dodecanoate, 2-ethyl hexanoate, Neodecanoate or mixtures thereof.

3. The automatic transmission fluid according to claims 1 or 2 wherein said transition metal is copper.

4. The automatic transmission fluid according to claims 2 or 3 wherein the concentration of the transition metal salt ranges from about 1 ppm to about 450 ppm by weight.

5. The automatic transmission fluid according to claim 4 wherein said transition metal salt is in the concentration range of about 1 ppm to about 150 ppm by weight.

6. The automatic transmission fluid according to claim 4 wherein said transition metal compound is in the concentration range of about 20 ppm to about 100 ppm by weight.

7. A gear lubricant comprising a high temperature anti-thickening effective amount of an oil-soluble transition metal salt with the proviso that the transition metal is not zinc, wherein said transition metal salt is a salt wherein the non-metal moiety is selected from the group consisting of dihydrocarbylthio- or dithiophosphate, a dihydrocarbylthio- or dithiocarbamate, a hydrocarbyl carboxylic acid, a hydrocarbylsulfonate, hydrdocarbylphenate or mixtures thereof and wherein the metal is selected from the group consisting of copper, cobalt, tungsten, titanium, manganese, iron, chromium, nickel, vanadium, molybdenum or mixtures thereof.

8. The gear lubricant according to claim 7 wherein said non-metal moiety is selected from the group consisting of alkylbenzenesulfonates, alkylsulfonates, dialkyldithiophosphates, naphthenate, stearate, palmitate, oleate, dodecanoate, 2-ethylhexanoate, Neo-decanoate, or mixtures thereof.

9. The gear lubricant according to claims 7 or 8 wherein said transition metal is copper.

10. The gear lubricant according to claims 8 or 9 wherein the concentration of the transition metal ranges from about 1 ppm to about 450 ppm by weight.

11. The gear lubricant according to claim 10 wherein the concentration of the transition metal ranges from about 25 ppm to about 300 ppm by weight.

12. The gear lubricant according to claim 10 wherein the concentration of the transition metal ranges from about 100 ppm to about 250 ppm by weight.

13. A method for ameliorating low temperature thickening in automatic transmission fluids comprising admixing a low temperature anti-thickening effective amount of an oil-soluble transition metal salt to a major amount of an automatic transmission fluid with the proviso that the transition metal is not zinc.

14. The method according to claim 13 wherein said transition metal salt is a salt wherein the non-metal moiety is selected from the group consisting of a dihydrocarbylthio- or dithiophosphate, a dihydrocarbylthio- or dithiocarbamate, a hydrocarbyl carboxylic acid, a hydrocarbylsulfonate, hydrocarbylphenate or mixtures thereof and wherein said transition metal is selected from the group consisting of copper, cobalt, tungsten, titanium, manganese, iron, chromium, nickel, vanadium, molybdenum or mixtures thereof.

15. The method according to claim 14 wherein said non-metal moiety is selected from the group consisting of alkylbenzenesulfonates, alkylsulfonates, dialkyldithiophosphates, naphthenate, stearate, palmitate, oleate, dodecanoate, 2-ethylhexanoate, Neo-decanoate, acetyl acetonate and mixtures thereof.

16. The method according to claims 13, 14 or 15 wherein said transition metal is copper.

17. The method according to claims 13, 14, 15 or 16 wherein the concentration of the transition metal ranges from about 1 ppm to about 450 ppm by weight.

18. The method according to claim 17 wherein said transition metal is in the concentration range of about 1 ppm to about 150 ppm by weight.

19. The method according to claim 17 wherein said transition metal is in the concentration range of about 20 ppm to about 100 ppm by weight.

20. A method for ameliorating high temperature thickening in gear lubricants comprising admixing a high temperature anti-thickening effective amount of an oil soluble transition metal salt to a major amount of a gear lubricant with the proviso that the transition metal is not zinc.

21. The method according to claim 20 wherein said transition metal salt is a salt wherein the non-metal moiety is selected from the group consisting of a dihydrocarbyl thio- or dithiophosphate, a dihydrocarbylthio- or dithiocarbamate, a hydrocarbyl carboxylic acid, a hydrocarbylsulfonate, hydrocarbylphenate or mixtures thereof and wherein said transition metal is selected from the group consisting of copper, cobalt, tungsten, titanium, manganese, iron, chromium, nickel, vanadium, molybdenum or mixtures thereof.

22. The method according to claim 21 wherein said non-metal moiety is selected from the group consisting of alkylbenzenesulfonates, alkylsulfonates, dialkyldithiophosphates, naphthenate, stearate, palmitate, oleate, dodecanoate, 2-ethylhexanoate, Neo-decanoate, acetyl acetonate and mixtures thereof.

23. The method according to claims 20, 21 or 22 wherein said transition metal is copper.

24. The method according to claims 20, 21, 22 or 23 wherein the concentration of the transition metal ranges from about 1 ppm to about 450 ppm by weight.

25. The method according to claim 24 wherein said transition metal is in the concentration range of about 25 ppm to about 300 ppm by weight.

26. The method according to claim 25 wherein said transition metal is in the concentration range of about 100 ppm to about 250 ppm by weight.

27. A concentrate for the preparation of an automatic transmission fluid comprising a solvent or diluent and from about 20% to about 99% by weight of a combination of oil-soluble transition metal salt of claims 2, 3, or 4 and other additives to make up a usable automatic transition fluid.

28. A concentrate for the preparation of a gear lubricant comprising a solvent or diluent and from about 20% to about 99% by weight of a combination of oil-soluble transition metal salt of claims 10 or 11 and other additives to make up a usable gear lubricant.

* * * * *